US010584921B2

(12) United States Patent
Steinbach et al.

(10) Patent No.: US 10,584,921 B2
(45) Date of Patent: Mar. 10, 2020

(54) HEAT EXCHANGER AND METHOD OF MAKING THE SAME

(71) Applicant: Modine Manufacturing Company, Racine, WI (US)

(72) Inventors: Eric Steinbach, Wausau, WI (US); Mark Johnson, Racine, WI (US); Arthur Harford, Kenosha, WI (US); Siddharth Jain, Lindenhurst, IL (US)

(73) Assignee: Modine Manufacturing Company, Racine, WI (US)

( * ) Notice: Subject to any disclaimer, the term of this patent is extended or adjusted under 35 U.S.C. 154(b) by 343 days.

(21) Appl. No.: 15/129,026

(22) PCT Filed: Mar. 25, 2015

(86) PCT No.: PCT/US2015/022476
§ 371 (c)(1),
(2) Date: Sep. 26, 2016

(87) PCT Pub. No.: WO2015/148657
PCT Pub. Date: Oct. 1, 2015

(65) Prior Publication Data

US 2017/0146299 A1 May 25, 2017

Related U.S. Application Data

(60) Provisional application No. 61/971,614, filed on Mar. 28, 2014.

(51) Int. Cl.
*F28D 1/047* (2006.01)
*B21D 53/08* (2006.01)
(Continued)

(52) U.S. Cl.
CPC ..... *F28D 1/0476* (2013.01); *B21D 53/085* (2013.01); *F28D 1/0435* (2013.01);
(Continued)

(58) Field of Classification Search
CPC ..... F28D 1/0435; F28D 1/047; F28D 1/0471; F28D 1/0476; F28F 1/12; F28F 1/128;
(Continued)

(56) References Cited

U.S. PATENT DOCUMENTS 3,443,296 A * 5/1969 Clausing ..... B21D 7/066 29/890.04
4,443,921 A * 4/1984 Allemandou ..... B21D 53/027 29/890.046
(Continued)

FOREIGN PATENT DOCUMENTS

CN 1410738 4/2003
CN 102207347 10/2011
(Continued)

OTHER PUBLICATIONS

JP 02205251A Machine Translation.*
(Continued)

*Primary Examiner* — Keith M Raymond
*Assistant Examiner* — Gustavo A Hincapie Serna
(74) *Attorney, Agent, or Firm* — Michael Best & Friedrich LLP; Jeroen Valensa; Michael Bergnach

(57) ABSTRACT

A heat exchanger includes first and second sets of parallel arranged tubes. The first set of tubes extends along a first arcuate path, the second set of tubes extends along a second arcuate path, and each one of the second set of tubes is aligned in a common plane with a corresponding one of the first set of tubes. Corrugated fin segments are arranged in spaces between adjacent tubes, and crests and troughs of the corrugated fin segments are joined to broad and flat faces of the tubes. In making the heat exchanger, the material of the corrugated fin segment is intermittently slit to define breaking points prior to arranging the corrugated fin segment between the tubes.

13 Claims, 7 Drawing Sheets

(51) Int. Cl.
*F28F 1/12* (2006.01)
*F28D 1/04* (2006.01)

(52) U.S. Cl.
CPC ..... *F28D 1/0471* (2013.01); *F28F 1/128* (2013.01); *F28F 2215/02* (2013.01)

(58) Field of Classification Search
CPC ..... F28F 2215/02; B21D 53/02; B21D 53/08; B21D 53/085
USPC ..... 165/152, 176
See application file for complete search history.

(56) References Cited

U.S. PATENT DOCUMENTS

| | | | | |
|---|---|---|---|---|
| 4,727,737 | A | 3/1988 | Bryant | |
| 4,876,778 | A | 10/1989 | Hagihara et al. | |
| 5,076,353 | A | 12/1991 | Haussmann | |
| 5,267,610 | A * | 12/1993 | Culbert | B21D 53/085 165/151 |
| 5,531,268 | A | 7/1996 | Hoshino et al. | |
| 6,357,518 | B1 * | 3/2002 | Sugimoto | F28D 1/0435 165/135 |
| 6,408,939 | B1 * | 6/2002 | Sugimoto | F28D 1/0435 165/135 |
| 6,502,305 | B2 | 1/2003 | Martins et al. | |
| 6,672,375 | B1 * | 1/2004 | Shippy | F24F 1/0059 165/122 |
| 6,938,684 | B2 * | 9/2005 | Iwasaki | F28D 1/0408 165/135 |
| 7,699,095 | B2 * | 4/2010 | Beamer | F28D 1/05366 165/151 |
| 7,921,904 | B2 | 4/2011 | Matter et al. | |
| 8,776,873 | B2 | 7/2014 | Mross et al. | |
| 9,891,007 | B2 * | 2/2018 | He | F28F 1/025 |
| 10,156,400 | B2 * | 12/2018 | Nakamura | F28D 1/047 |
| 2001/0022220 | A1 * | 9/2001 | Ozaki | F28D 1/0435 165/135 |
| 2002/0125000 | A1 | 9/2002 | Nozaki et al. | |
| 2003/0075307 | A1 * | 4/2003 | Stoynoff | F28D 1/0435 165/135 |
| 2003/0106677 | A1 * | 6/2003 | Memory | F25B 39/04 165/135 |
| 2008/0141525 | A1 | 6/2008 | Breiding et al. | |
| 2011/0139425 | A1 * | 6/2011 | Beamer | F28D 1/0476 165/175 |
| 2011/0240271 | A1 * | 10/2011 | Mross | F28D 1/05391 165/166 |
| 2013/0020061 | A1 | 1/2013 | Bergh | |
| 2014/0007600 | A1 | 1/2014 | Johnson et al. | |
| 2016/0169586 | A1 * | 6/2016 | Ito | F24F 13/30 165/104.21 |
| 2017/0219298 | A1 * | 8/2017 | Tsutsui | F28D 1/053 |

FOREIGN PATENT DOCUMENTS

| | | | | |
|---|---|---|---|---|
| CN | 102699155 | | 10/2012 | |
| EP | 1331463 | A | 7/2003 | |
| JP | 02205251 | A * | 8/1990 | F28D 1/0471 |
| JP | H02205251 | A | 8/1990 | |
| JP | 2514416 | | 7/1996 | |
| JP | 2002168581 | A | 6/2002 | |
| JP | 2002224756 | A | 8/2002 | |
| JP | 2010-169289 | | 8/2010 | |
| JP | 2013252560 | A | 12/2013 | |
| WO | 03050468 | A1 | 6/2003 | |

OTHER PUBLICATIONS

Japanese Patent Office Action for Application No. 2016-559540 dated May 1, 2018 (15 pages, English translation Included).
Japanese Patent Office Action for Application No. 2016-559540 dated Dec. 4, 2017 (21 pages, English translation included).
International Search Report and Written Opinion for Application No. PCT/US2015/022476 dated Jun. 25, 2015 (16 pages).
Chinese Patent Office Action for Application No. 201580015606.5 dated Feb. 24, 2018 (29 pages, English translation included).
First Office Action from the State Intellectual Property Office of China for Application No. 2015800156065 dated Jun. 5, 2017 (28 pages).

* cited by examiner

HEAT EXCHANGER AND METHOD OF MAKING THE SAME

CROSS-REFERENCE TO RELATED APPLICATIONS

The present application claims priority to U.S. Applications 61/971,614, filed Mar. 28, 2014, the entire contents of which are hereby incorporated by reference.

BACKGROUND

The present application related to heat exchangers and methods of making heat exchangers, and particularly relates to curved or non-planar heat exchangers.

Vapor compression systems are commonly used for refrigeration and/or air conditioning and/or heating, among other uses. In a typical vapor compression system, a refrigerant, sometimes referred to as a working fluid, is circulated through a continuous thermodynamic cycle in order to transfer heat energy to or from a temperature and/or humidity controlled environment and from or to an uncontrolled ambient environment. While such vapor compression systems can vary in their implementations, they most often include at least one heat exchanger operating as an evaporator, and at least one other heat exchanger operating as a condenser.

In systems of the aforementioned kind, a refrigerant typically enters an evaporator at a thermodynamic state (i.e., a pressure and enthalpy condition) in which it is a sub-cooled liquid or a partially vaporized two-phase fluid of relatively low vapor quality. Thermal energy is directed into the refrigerant as it travels through the evaporator, so that the refrigerant exits the evaporator as either a partially vaporized two-phase fluid of relatively high vapor quality or a superheated vapor.

At another point in the system the refrigerant enters a condenser as a superheated vapor, typically at a higher pressure than the operating pressure of the evaporator. Thermal energy is rejected from the refrigerant as it travels through the condenser, so that the refrigerant exits the condenser in an at least partially condensed condition. Most often the refrigerant exits the condenser as a fully condensed, sub-cooled liquid.

Some vapor compression systems are reversing heat pump systems, capable of operating in either an air conditioning mode (such as when the temperature of the uncontrolled ambient environment is greater than the desired temperature of the controlled environment) or a heat pump mode (such as when the temperature of the uncontrolled ambient environment is less than the desired temperature of the controlled environment). Such a system may require heat exchangers that are capable of operating as an evaporator in one mode and as a condenser in another mode.

It may on occasion be desirable for a heat exchanger operating as a condenser and/or as an evaporator in such systems to have a non-planar shape, particularly a curved or arcuate shape. To that end, it is known for refrigerant heat exchangers to be constructed with a generally planar shape and to then be bent or formed into a curved shape. Performing such deformation without causing damage to the heat exchanger can be problematic, however, and is typically limited to heat exchangers having a single column of tubes and/or heat exchangers having a small core depth dimension and/or heat exchangers with an especially large radius of curvature.

SUMMARY

According to an embodiment of the invention, a method of making a heat exchanger includes slitting a sheet of material to define a first section and a second section, forming the sheet of material to define serpentine corrugations, and separating the formed sheet of material into a plurality of fin segments. The first and second sections are joined together at spaced-apart connecting points, and each fin segment includes one or more of the connecting points. The fin segments are alternatingly arranged between rows of flat tubes to define a core stack, which is brazed to form a monolithic heat exchanger core. The heat exchanger core is bent into an arcuate shape having a radial direction, such that one of the first and second tube lengths of each row is located radially inward of the other. The bending of the heat exchanger core severs at least one of the connecting points of each fin segment.

According to another embodiment of the invention, a method of making a heat exchanger includes arranging a first tube and a second tube to define a first row of tubes, and arranging a third and a fourth tube to define a second row of tubes parallel to and offset from the first row of tubes. Corresponding broad and flat sides of the tubes in each row are aligned in common planes, the first and third tubes are aligned to define a first column of tubes, and the second and fourth tubes are aligned to define a second column of tubes. A corrugated fin segment is arranged between the first and second row of tubes, and peaks and troughs of the corrugations of the corrugated fin segment are brazed to a broad and flat side of each of the first, second, third, and fourth tubes. The brazed tubes and fin segment are bent into an arcuate shape having an axis aligned in a perpendicular direction to the broad and flat sides of the tubes, and this bending at least partially separates the corrugated fin segment into a first section joined to the first and third tubes, and a second section joined to the second and fourth tubes.

In some embodiments, the first and third tubes are bent to define a first bend radius, and the second and fourth tubes are bent to define a second bend radius that is larger than the first bend radius. In some embodiments the material of the corrugated fin segment is intermittently slit to define breaking points prior to arranging the corrugated fin segment between the first and second row of tubes.

According to another embodiment of the invention, a heat exchanger includes first and second sets of parallel arranged tubes. The first set of tubes extends along a first arcuate path, and the second set of tubes extends along a second arcuate path. Each one of the second set of tubes is aligned in a common plane with a corresponding one of the first set of tubes. Corrugated fin segments are arranged in spaces between adjacent tubes, and crests and troughs of the corrugated fin segments are joined to broad and flat faces of the tubes. Each of the tubes has one or more fluid conduits extending through the tube. A common header fluidly joins the fluid conduits of each one of the second set of tubes with the fluid conduits of the corresponding one of the first set of tubes.

In some embodiments, the corrugated fin segments include a first series of flanks connecting the crests and troughs joined to the first set of tubes, and a second series of flanks connecting the crests and troughs joined to the second set of tubes. The first series of flanks of each corrugated fin segment is disconnected from the second series of flanks of that corrugated fin segment over at least a majority of the fin segment.

In some embodiments the first arcuate path defines a first axis and a first radius, the second arcuate path defines a second axis and a second radius, the second axis is aligned with the first axis, and the second radius is not equal to the first radius.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
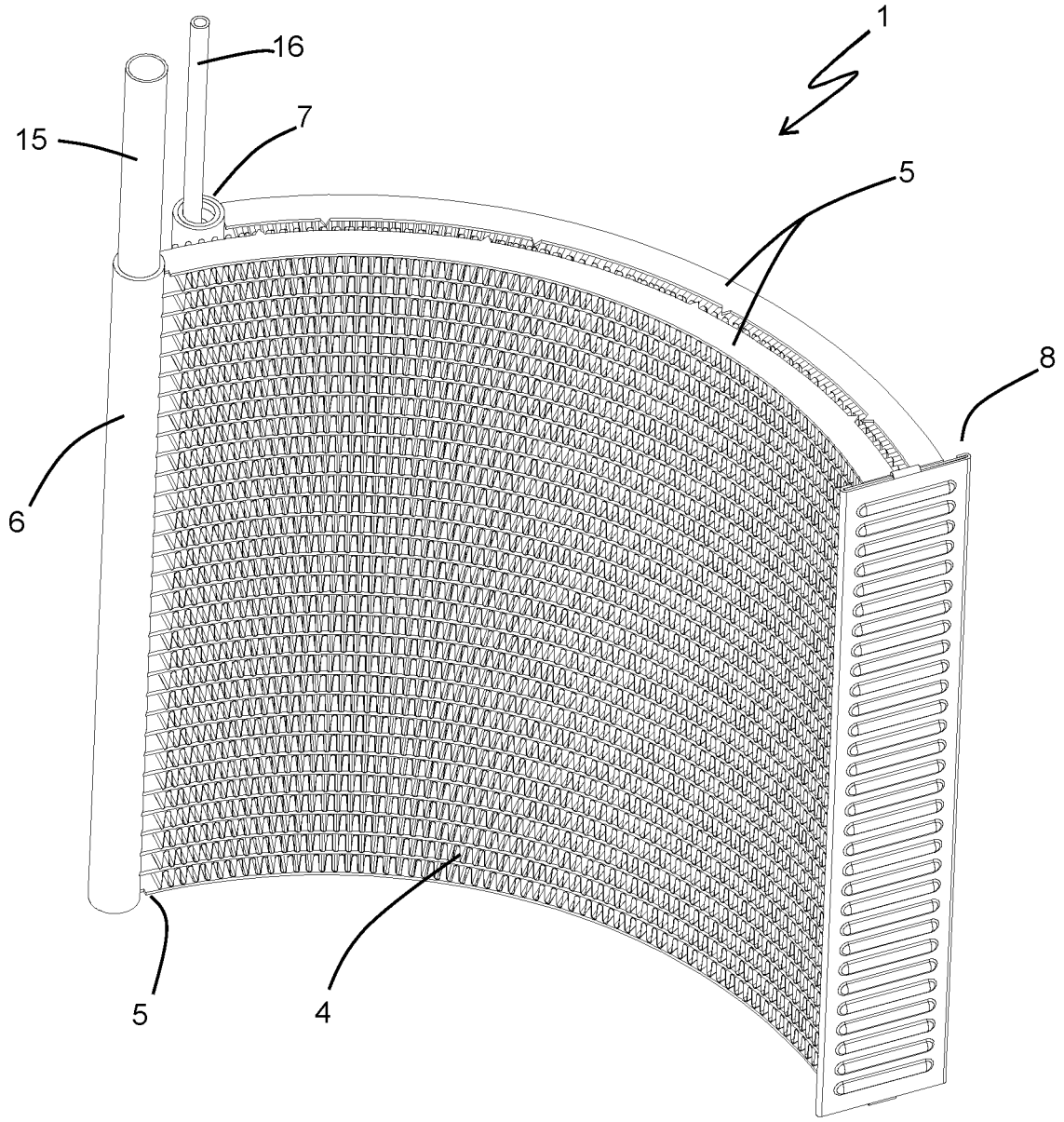
FIG. 1 is a perspective view of a heat exchanger according to an embodiment of the invention.

A heat exchanger 1 according to an embodiment of the present invention is depicted in FIG. 1, and includes a plurality of tube lengths 2 to convey a fluid through the heat exchanger 1. The tube lengths 2 are arranged in a series of rows and columns to allow for a combination of series and parallel flow of the fluid, and corrugated fin segments 3 are arranged between adjacent rows of the tube lengths 2 to provide both structural connection between the adjacent rows and extended heat transfer surface area. The heat exchanger 1 is formed into an approximately arcuate shape, as will be described. Such a heat exchanger 1 can be find utility in any number of heat transfer applications, and can be especially useful as an evaporator or a condenser or both in a refrigerant system.

Figure 2:
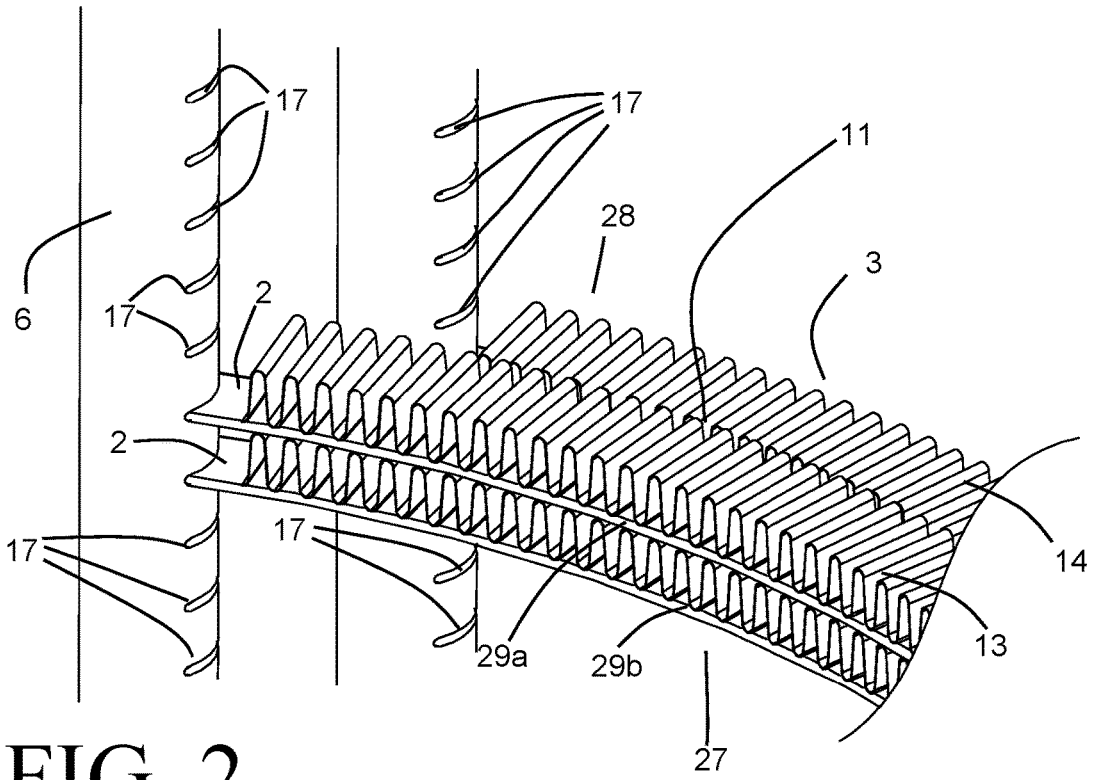
FIG. 2 is a partial perspective view of a portion of the heat exchanger of FIG. 1, with some parts removed for clarity.

For ease of reference only a portion of the heat exchanger 1, with selected ones of the tube lengths 2 and corrugated fin segments 3 hidden from view, is shown in FIG. 2. Specifically, FIG. 2 illustrates two rows (29*a* and 29*b*) of tube lengths 2, each of the rows 29*a* and 29*b* including two of the tube lengths 2, with one of the tube lengths 2 from each row being arranged into a first column 27, and the other one of the tube lengths 2 from each row being arranged into a second column 28. Ends of those tube lengths 2 belonging to the first column 27 are received into slots 17 provided in a first tubular header 6, and ends of those tube lengths 2 belonging to the second column 28 are received into similar slots 17 provided in a second tubular header 7.

With continued reference to FIG. 2, the corrugated fin segments 3 include a series of relatively planar flanks connected by alternating peaks and troughs. The peaks and troughs are joined to generally planar broad sides of the tube lengths 2, preferably by a metallurgical joining technique such as brazing.

The arcuate shape of the heat exchanger 1 can provide certain benefits over a generally planar heat exchanger in applications that require a compact packaging arrangement between the heat exchanger and, for example, an air mover directing a flow of air over the external surfaces of the heat exchanger tubes, wherein effecting the efficient transfer of heat between a fluid flowing through those tubes and the flow of air is desirable. As one non-limiting example, refrigerant-based systems of the type commonly referred to as "ductless mini-split" systems typically incorporate an air mover directing a flow of air in a generally radial direction through a heat exchanger within a compact package. By providing a heat exchanger 1 with an arcuate profile and locating the air moves at approximately the center axis of the arcuate profile, a greater amount of heat exchange surface area can be provided within the same amount of space.

Referring back to FIG. 1, the heat exchanger 1 is provided with a first port 15 joined to and in fluid communication with the tubular header 6, and with a second port 16 joined to and in fluid communication with the tubular header 7. A common header 8 receiving ends of the tube lengths 2 opposite to those ends received into the tubular headers 6 and 7 is arranged at an end of the heat exchanger 1. The exemplary common header 8 of the embodiment of FIG. 1 is described in greater detail in co-pending U.S. patent application Ser. No. 13/076,607, filed on Mar. 31, 2011 and assigned to the Applicant of the present application, the entire contents of which are hereby incorporated by reference. The common header 8 receives ends of tube lengths 2 from both columns 27 and 28, and provides for fluid communication between those ones of the tube lengths 2 arranged into a common row 29. In this way, those tube lengths 2 arranged in a single column 27 or 28 can be arranged hydraulically in parallel with one another, whereas the columns 27, 28 themselves can be arranged hydraulically in series with each other.

When the heat exchanger 1 is assembled into a system, highly efficient heat exchange between a fluid (for example, a refrigerant) passing through the tube lengths 2 and an air flow passing over the tube lengths 2 can be achieved. As one non-limiting example, the heat exchanger 1 can be used as a refrigerant evaporator to cool and/or dehumidify a flow of air by receiving into the port 16 a flow of at least partially liquid refrigerant having a relatively low boiling temperature. The refrigerant is distributed within the tubular header 7 to the tube lengths 2 of the column 28, and is circulated therethrough to the common header 8, wherein the refrigerant is transferred to the tube lengths 2 of the column 27. The refrigerant subsequently travels through those tube lengths of the column 27 to the tubular header 6, wherein the refrigerant is collected and is removed from the heat exchanger 1 by way of the port 15. As the refrigerant passes through the tube lengths 2, air at a temperature that is generally in excess of that boiling point temperature is directed over the tube lengths 2 to transfer heat into the refrigerant, thereby cooling and/or dehumidifying the air while causing the refrigerant to evaporate. The counter-cross arrangement of refrigerant and air flows provides increased heat transfer effectiveness over a purely cross-flow arrangement.

As another non-limiting example, the heat exchanger 1 can be used as a refrigerant condenser to heat a flow of air by receiving into one the port 16 a flow of superheated refrigerant vapor having a relatively high condensing temperature, and circulating the refrigerant through the heat exchanger 1 in a similar manner as described above to heat a flow of air passing over the tube lengths 2. In some embodiments it can be preferable to have the heat exchanger 1 operate as a condenser in one operating mode, and as an evaporator in another operating mode. In such embodiments it can be preferable for refrigerant to be received into the heat exchanger 1 through the port 16 and removed through the port 15 in one operating mode, and vice-versa in the other operating mode.

Figure 4:
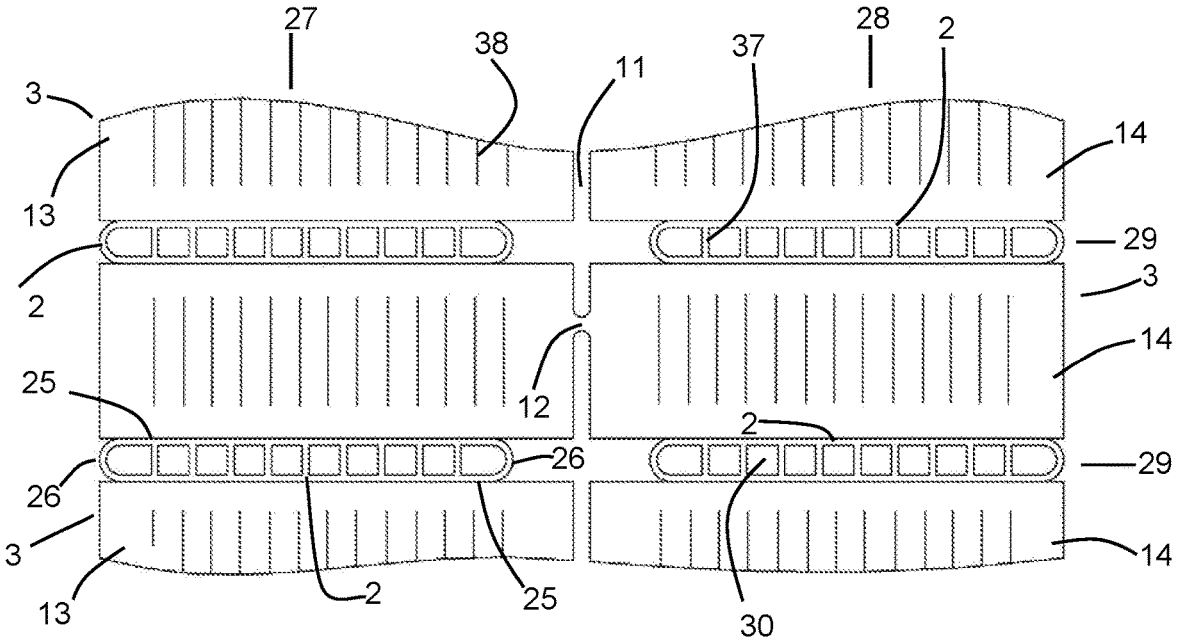
FIG. 4 is a partial view taken along the lines IV-IV of FIG. 3.
Figure 3:
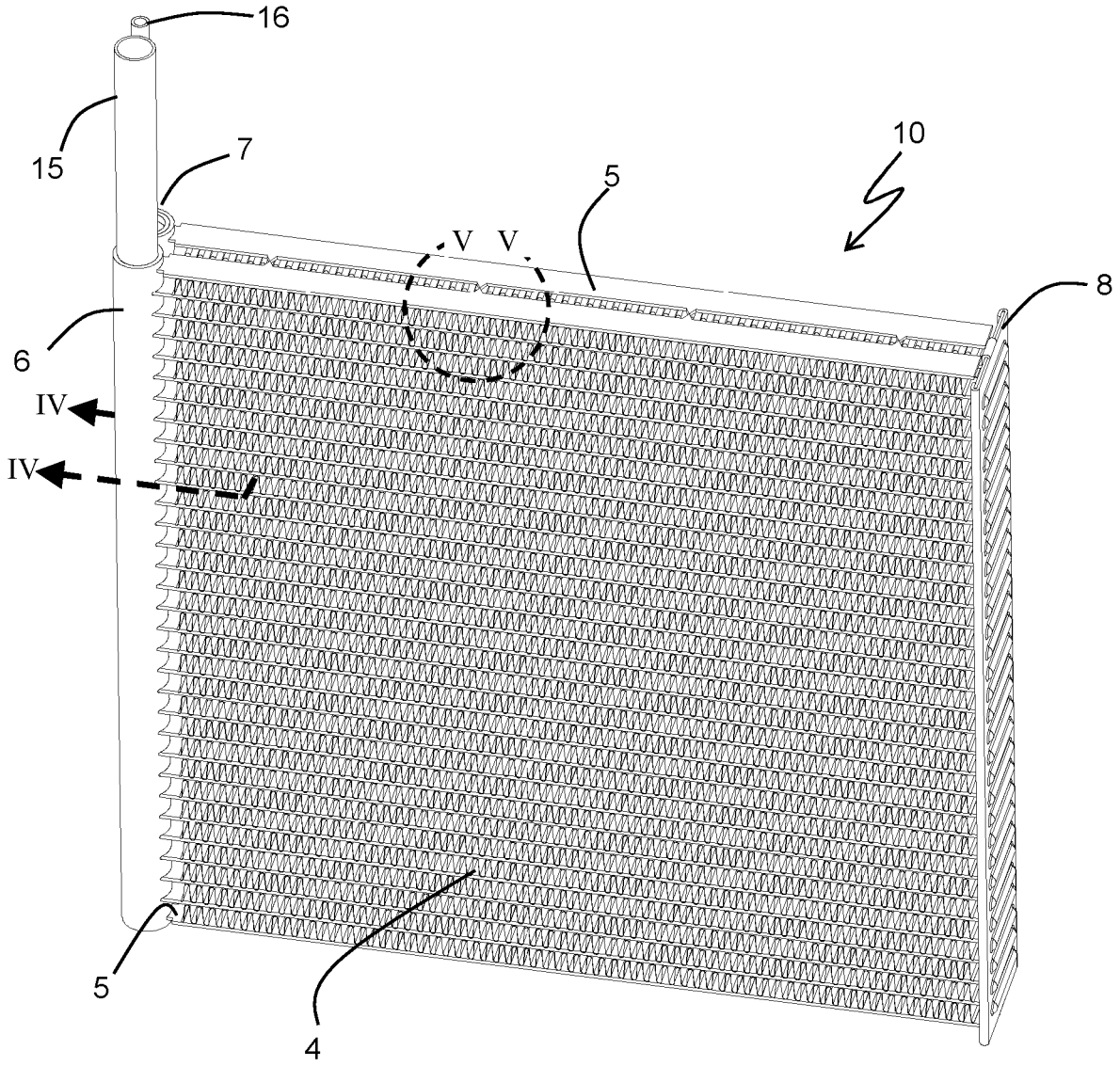
FIG. 3 is a perspective view of the heat exchanger of FIG. 1 in an unfinished condition.

According to some embodiments of the invention, the heat exchanger 1 is first formed as a planar h eat exchanger core 10 (shown in FIG. 3) and is thereafter deformed by a bending operation into the arcuate shape shown in FIG. 1. The planar heat exchanger core 10 can be made by stacking the tube lengths 2 in alternating rows 29 of (for example) two tube lengths 2 each and corrugated fin segments 3 to define a core stack 4. As best seen in FIG. 4, tube lengths 2 within a give row 29 are arranged so that corresponding broad sides 25 of the tube lengths 2 are coplanar, and the rows 29 are arranged relative to one another such that the tube lengths 2 are arranged into columns 27 and 28, each such column containing a tube length 2 of each of the rows 29. Space is provided between adjacent tube lengths 2 in each of the columns 27, 28 so that corrugated fin segments 3 can be interposed between the adjacent tube lengths 2.

FIG. 4 depicts a repeating arrangement of tube lengths 2 and corrugated fin segments 3, and will be used to describe certain aspects of those tube lengths 2 and corrugated fin segments 3 in greater detail. The tube lengths 2 include opposing broad and flat sides 25 joined by narrow sides 26. The narrow sides 26 are shown as being arcuate in shape, although in some embodiments the narrow sides 26 can be planar or some other shape as may be desired. Internal webs 37 are disposed between the narrow sides 26 to join the broad and flat sides 25, thereby subdividing the internal chamber within the tube length 2 into a plurality of parallel arranged fluid conduits 30. The webs 37 further provide additional benefit by increasing the internal surface area of the tube length 2 so as to improve the rate of heat transfer within the tube, as well as providing structural support for the broad and flat sides 25. Such a tube length 2 can, for example, be produced through an extrusion process. It should be understood that the number of webs 37 within the tube length 2 can be varied in order to optimize the performance of the heat exchanger 1, and in some embodiments the webs 37 can be dispensed with entirely and a single conduit 30 can be provided within each tube length 2.

As further shown in FIG. 4, the corrugated fin segments 3 arranged between adjacent rows 29 of tube lengths 2 have a width dimension that is approximately equal to the total core depth. A slit 11 is provided in each of the corrugate fin segments 3 along an approximately central location in the width dimension, the slit 11 functioning to divide the corrugated fin segment 3 into a first fin section 13 joined to tube lengths 2 in the first column 27, and a second fin section 14 joined to tube lengths 2 in the second column 28. In order to further improve the heat transfer performance of the heat exchanger 1, louvers 38 or other types of known turbulation enhancement features can be added to the flanks of the corrugated fin segments 3, as shown.

Connecting points 12 span the slit 11 and are intermittently spaced to connect the first fin section 13 to the second fin section 14 at several points along the length of the corrugate fin segment 13. The presence of the connecting points 12 serve to maintain each of the corrugated fin segments 3 as a unitary piece during the assembly of the planar heat exchanger 10. The connecting points can be arranged to join the sections 13, 14 at the flanks, crests, troughs, or some combination thereof. In some preferable embodiments, the tube lengths 2, the corrugated fin segments 3, and optionally the tubular headers 6 and 7 and the common header 8 are all formed from aluminum alloys, and are joined together in a single brazing operation to form a monolithic heat exchanger core 4. A brazing alloy having a lower temperature than the base aluminum alloys can be added to one or more of the components, for example as a clad layer. During the brazing operation, the assembled components are heated to a temperature at which the brazing alloy melts, and the liquid braze alloy is allowed to reflow over the joints between adjacent parts in order to provide metallurgical joints between those parts upon cooling of the planar heat exchanger core 10.

Figure 7:
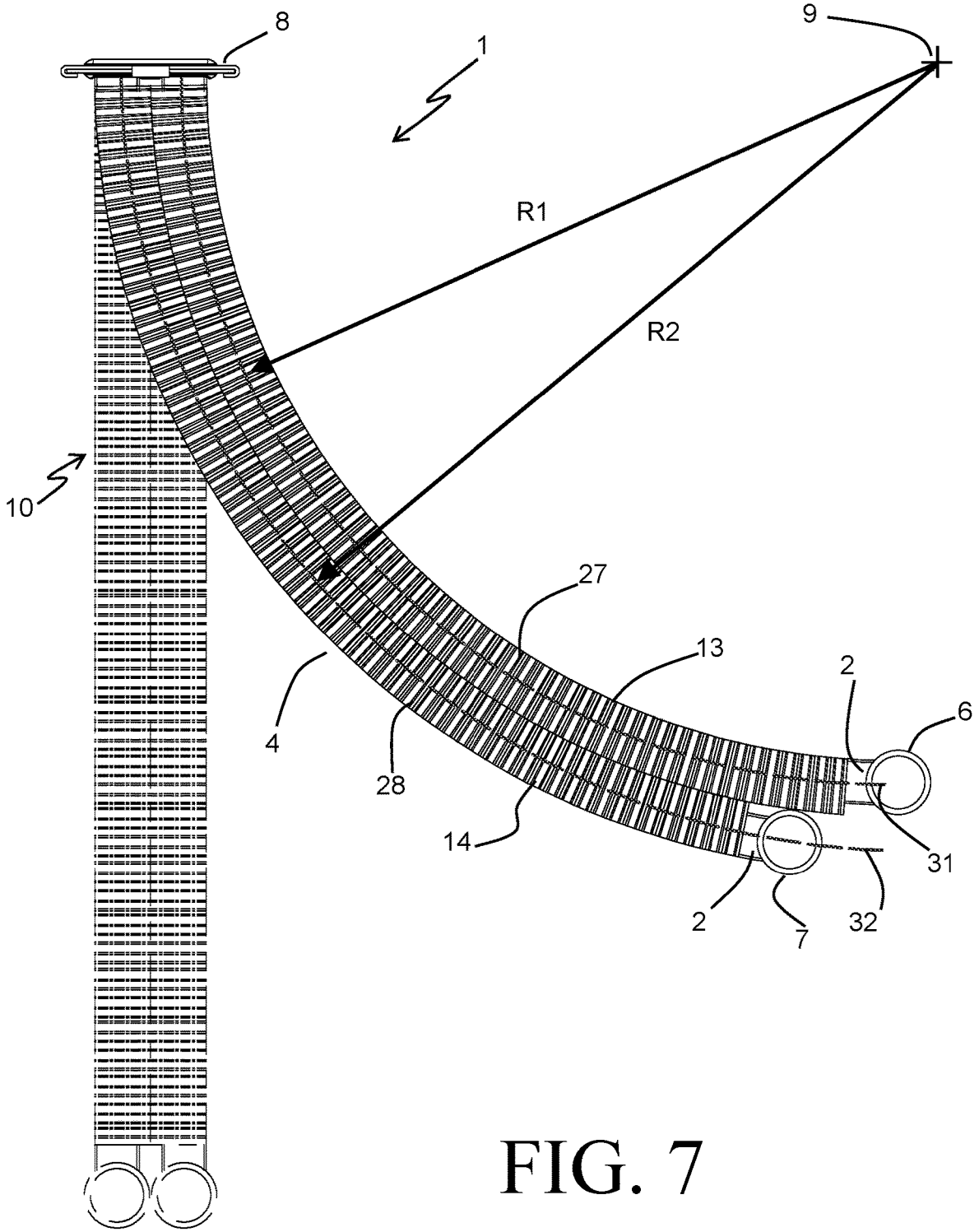
FIG. 7 is a plan view of the heat exchanger of FIG. 1 undergoing a forming operation according to an embodiment of the invention.

When the planar heat exchanger core 10 is bent into the shape of the curved heat exchanger 1, as shown in FIG. 7, those ends of the tube lengths 2 that are joined to the common header 8 remain in their original alignment to one another. The tubular headers 6 and 7, by contrast, move relative to one another as shown. By bending the first column 27 and the second column 28 of tube lengths 2 about a common axis 9 that is perpendicular to the broad and flat sides 25 of the tube lengths 2, those tube lengths 2 of the first column 27 are formed along a first arcuate path 31 having a first radial dimension R1, while those tube lengths 2 of the second column 28 are formed along a second arcuate path 32 having a second radial dimension R2 that is greater than the first radial dimension. Accordingly, the relative positioning of the tubular headers 6 and 7 is not maintained by the bending process.

The inventors have found that when a corrugated fin segment lacking the slit 11 is used to construct the planar heat exchanger core, such a bending process results in severe buckling of the tube lengths, leaving the resulting heat exchanger unsuitable for use. This is because the joints produced between the crests and troughs of the corrugated fin segments and the broad and flat sides of tube lengths prevent the relative movement of tube lengths 2 within a row 29, as is required by the bent geometry of the heat exchanger 1 as shown in FIG. 7. However, when a corrugated fin segment 3 including the slit 11 is used, the bending process itself can serve to shear at least some of the connecting points 12, thereby allowing the fin sections 13 and 14 to move relative to one another in order to allow the tube lengths 2 to follow the desired arcuate paths 31 and 32. Accordingly, the connecting points 12 can also be referred to as breaking points 12.

Constructing the bent heat exchanger 1 in such a manner solves several of the problems heretofore associated with heat exchanger having a curved or arcuate shape. The fabrication of such a heat exchanger having more than a single row can be achieved, allowing for a curved heat exchanger with multiple fluid passes arranged in a concurrent flow or counter flow orientation to a flow of air. Furthermore, a smaller radius of curvature can be achieved for a given core depth, thereby facilitating the packaging of the heat exchanger into more compact spaces. By way of example, the heat exchanger 1 of FIG. 7 has a core depth of approximately 30 millimeters and the arcuate paths 31, 32 have radii of approximately 215 millimeters and 230 millimeters, respectively. It can be preferable for the radii of the arcuate paths to be no more than ten times the core depth.

Figure 5:
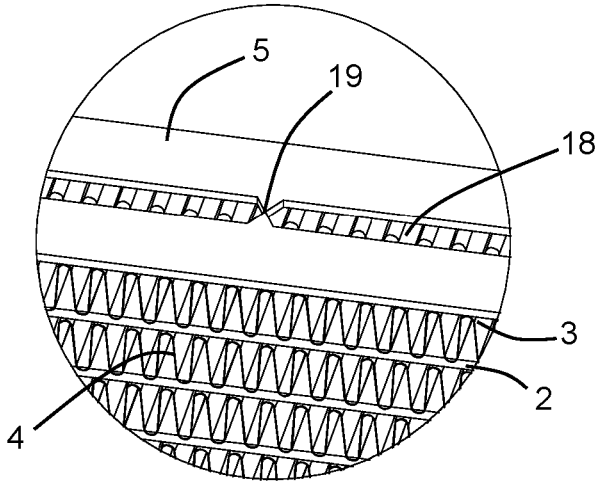
FIG. 5 is a detail view of the portion V-V of FIG. 3.

It can be desirable in some embodiments to include side plates 5 at the extreme ends of the stack of alternating tube lengths 2 and corrugated fin segments 3. Such side plates 5 allow for a compressive load to be applied to the stack and maintained during the brazing operation in order to ensure that the requisite contact between adjoining surfaces is maintained. In order to accommodate the bending of the planar heat exchanger 10 into the curved heat exchanger 1, the side plate 5 can be provided with a gap 18 extending along the length of the side plate 5 at an approximately central location in the width direction (i.e. between the first and second columns 27, 28). Connecting points 19 (best seen in FIG. 5) can be provided at several locations along the length of the side plate 5, and can be used to maintain the integrity of the side plate 5 for ease of handling during assembly. Those connecting points 19 can then be sheared during the bending operation in order to allow for the relative movement of the fin sections 13, 14 of those immediately adjacent corrugated fin segments 3.

Figure 6:
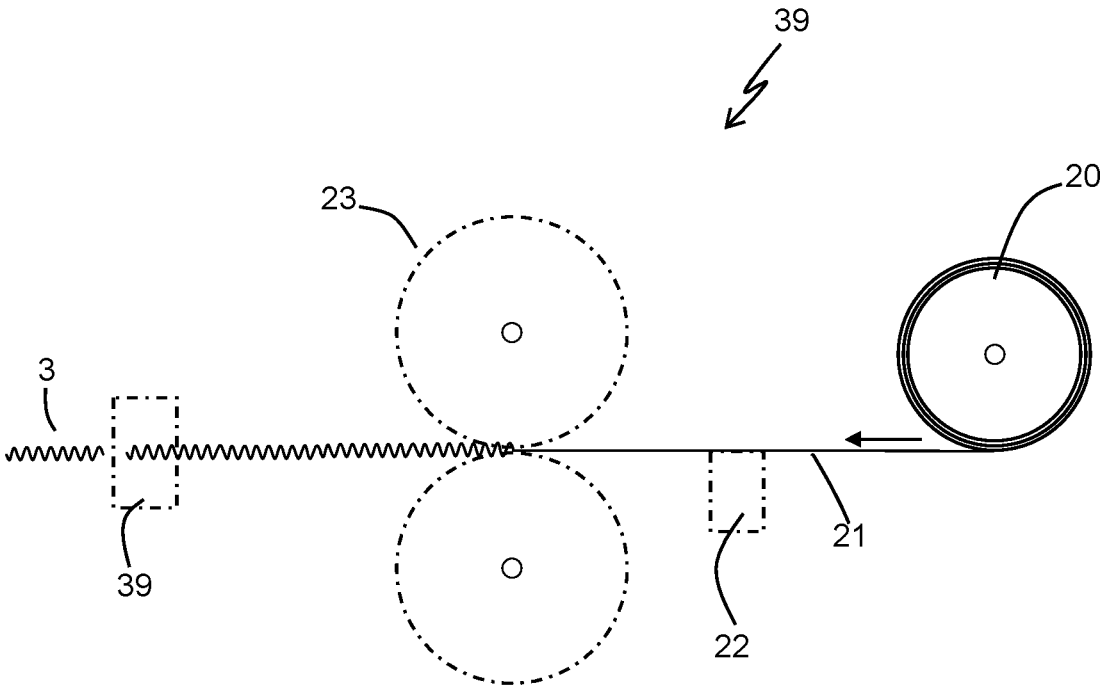
FIG. 6 is a diagram of a fin rolling operation according to an embodiment of the invention.

The corrugated fin segments 3 can be formed in a fin rolling operation 39 depicted in FIG. 6. A flat sheet 21 is unrolled from a roll of fin material 20, and progresses through a series of operations. At a slitting station 22 the slit 11 is formed into the sheet 21. By way of example only, the slitting station 22 can include a cutting blade that is cam-driven to produce the slit 11 with the connecting points 12 occurring at regular intervals. As the sheet 21 continues past the slitting station 22, a forming station 23 produces the corrugations in the sheet 21. The corrugated sheet 21 eventually reaches a separating station 24, where the continuous sheet 21 is separated into the discrete corrugated fin segments 3. The louvers 38, if present, can be formed either prior to the forming station 23 or within the forming station 23.

In some embodiments, the slit 11 can be formed by removing a portion of the flat sheet 21 at the slitting station 22, so that a gap of some dimension is formed between the first fin section 13 and the second fin section 14, as shown in FIG. 4. In other embodiments, it may be advantageous and preferable to form the slit 11 without the removal of material, thereby eliminating the need to dispose of the removed material and avoiding the possibility of equipment jamming or otherwise malfunctioning due to the presence of the removed material.

Figure 8:
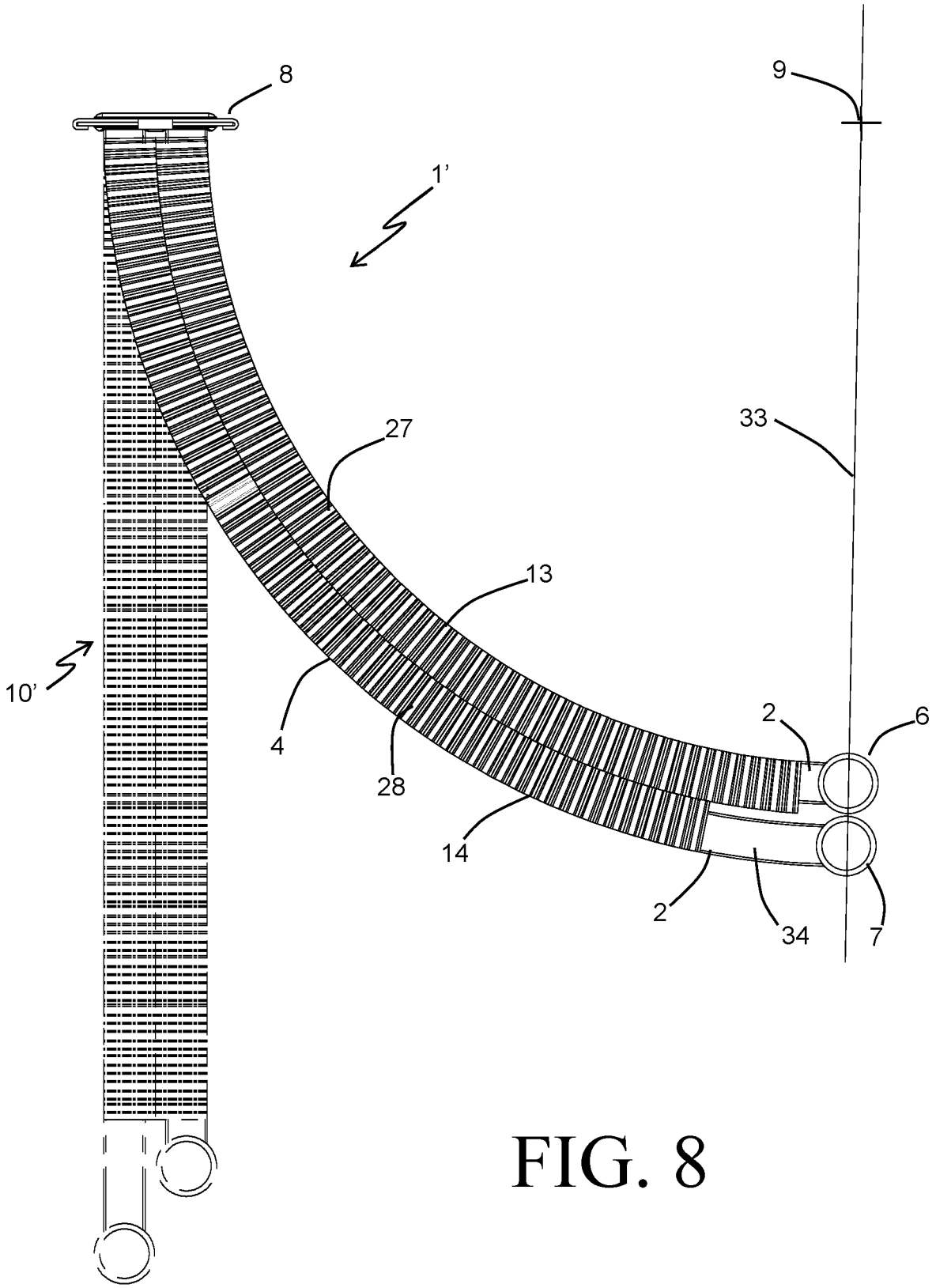
FIG. 8 is a plan view of a heat exchanger undergoing a forming operation according to an alternative embodiment of the invention.

An alternate embodiment of a curved heat exchanger 1', formed by constructing and then bending a planar heat exchanger core 10', is depicted in FIG. 8. The planar heat exchanger core 10' and the bent heat exchanger 1' have multiple aspects and features in common with the previously described planar heat exchanger core 10 and bent heat exchanger 1, respectively, and those features and aspects are numbered in similar fashion to that of FIG. 7. The planar heat exchanger core 10' again includes a first column 27 of tube lengths 2 and a second column 28 of tube lengths 2, with corrugated fin segments 3 arranged between aligned rows of the tube sections 2, crests and troughs of the corrugated fin segments 3 being bonded to the broad and flat surfaces of the adjacent tube lengths 2. The tube lengths 2 of the second column 28 are, however, longer in length than the tube lengths 2 of the first column 27. Consequently, the tube lengths 2 of that second column 28 have an un-finned region 34 of substantial length immediately adjacent to the tubular header 7 joined to the ends of the tube lengths 2 of the second column 28.

Upon bending of the planar heat exchanger core 10' to the shape of the bent heat exchanger 1', the varying lengths of the tube sections 2 in the two columns 27,28 can cause the centroidal axes of both of the tubular headers 6, 7 to lie in a common plane 33 passing through the bending axis 9. As a result, the blocking effect of the headers 6, 7 on a flow of air passing radially through the heat exchanger 1' is minimized, thereby also minimizing the undesirable pressure drop associated with such blocking of air flow.

Further benefits can additionally be realized by the presence of the un-finned region 34. In some particular embodiments, the heat exchanger 1' can be used in a reversing heat pump system. In such a system, the heat exchanger 1' can operate as a refrigerant evaporator when the system is operating in one mode of operation (for example, a cooling mode) and can operate as a refrigerant condenser in another mode of operation (for example, a heating mode). The flow of refrigerant is reversed between operating modes in such a system, so that in one operating mode the refrigerant passes are arranged in a counter flow orientation to the air flow while in the other operating mode the refrigerant passes are arranged in a concurrent flow orientation.

By way of example, in the cooling mode the refrigerant can enter into the heat exchanger 1 through the tubular header 7 as a two-phase refrigerant and, after receiving heat from the air passing through the core 4, can be removed from the heat exchanger 1 through the tubular header 6 as a slightly superheated refrigerant. The air is directed through the core 4 in a radially outward direction, passing first through the fin sections 13 and second through the fin sections 14. Consequently, the air encounters the downstream pass of the refrigerant (i.e. as the refrigerant moves through the tube lengths 2 of the column 27) prior to encountering the upstream pass of the refrigerant (i.e. as the refrigerant moves through the tube lengths 2 of the column 28), a flow orientation commonly referred to as counter flow. The flow of refrigerant is reversed in heating mode, and the refrigerant enters the tubular header 6 as a superheated refrigerant and, after rejecting heat to the air, exits the tubular header 7 as a sub-cooled liquid refrigerant. The air again moves through the core in a radially outward direction, so that in heating mode the air encounters the upstream pass of the refrigerant prior to encountering the downstream pass, a flow orientation commonly referred to as concurrent flow.

When the heat exchanger 1' operates as a refrigerant condenser (as in the above described heating mode), the refrigerant must first be sensibly cooled from a superheated vapor condition to a saturated vapor condition. Once the refrigerant reaches its saturation point, further heat removal to the air will condense the refrigerant to a saturated liquid, after which some additional heat is removed to sub-cool the liquid refrigerant. Achieving some amount of sub-cooling is known to be beneficial to the overall performance of the system. The arrangement of the tube lengths 2 in the heat exchanger 1' places the superheated vapor end and the sub-cooled liquid end of the refrigerant flow path adjacent to one another. This can cause problems in heating mode in that the portion of the air passing through the superheated vapor portion of the core 4, which is heated to a substantially higher temperature than the remainder of the air due to the elevated temperature of the superheated refrigerant passes directly over the portion of tube lengths 2 carrying the sub-cooled liquid refrigerant. That portion of the air can, in some cases, be heated to a temperature that exceeds the temperature of the sub-cooled liquid refrigerant, which could result in reheating of the refrigerant and a subsequent loss of sub-cooling. Having the un-finned region 34 located directly behind that portion of the column 27 where the de-superheating of the refrigerant occurs can effectively inhibit this undesirable heat transfer from the heated air to the sub-cooled refrigerant passing through that portion of the tube lengths 2 in the un-finned region 34.

Figure 9:
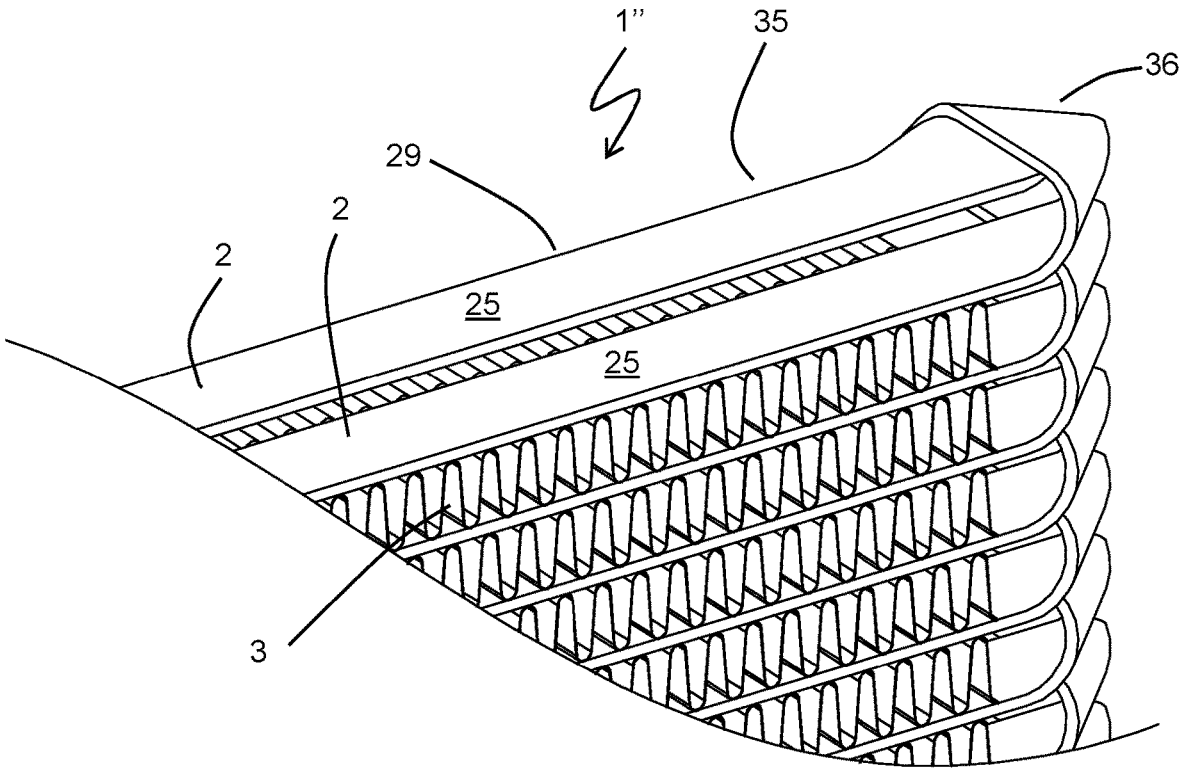
FIG. 9 is a partial perspective view of a portion of a heat exchanger according to an alternative embodiment of the invention.

FIG. 9 shows yet another embodiment of a heat exchanger according to the present invention. The planar heat exchanger core 10" of FIG. 9 also has multiple aspects and features in common with the previously described planar heat exchanger core 10, and those features and aspects are again numbered in similar fashion. In contrast to the heat exchanger core 10, the heat exchanger core 10" is constructed without the common header 8. Instead, the tube lengths 2 that make up a single row 29 are both parts of a single long tube 35. A folded return bend 36 in each of the tubes 35 places the two tube lengths 2 of that tube 35 into the side by side arrangement of a tube row 29. In so doing, the fluid conduits 30 within a tube 35 can remain unbroken between the tubular headers 6 and 7, so that re-distribution of fluid flow between such conduits at the transition from one tube length 2 of a tube row 29 to the other tube length 2 of that tube row can be avoided.

In constructing the planar heat exchanger core 10", each of the tubes 35 can be pre-bent to include the return bend 36 prior to assembly of the heat exchanger core. The fully assembled heat exchanger core 10" can subsequently be brazed and then bent to the desired final shape. The lack of a common header 8, and the relative flexibility of the return bends 36, allows for some or all of the relative movement of the ends of the tube lengths 2 resulting from the bending of the planar heat exchanger core 10" to occur at the return bends 36, as opposed to having all of that movement occurring at the tubular headers 6 and 7. This can allow for all of the connecting points 12 of the corrugated fin segments 3 to be broken, with less displacement occurring between corrugations of the first fin sections 13 and the second fin sections 14.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A method of making a heat exchanger, comprising:

slitting a sheet of material in a longitudinal direction to define a first section and a second section, the first and second sections being joined together at spaced-apart connecting points along the longitudinal direction;

forming the sheet of material to define serpentine corrugations;

separating the formed sheet of material into a plurality of fin segments, each fin segment having a plurality of the corrugations and one or more of the connecting points;

arranging the fin segments in alternating fashion between rows of flat tubes to define a core stack, each row comprising a first tube length and a second tube length in side-by side relation;

brazing the arranged fin segments and flat tubes to form a monolithic heat exchanger core, peaks and troughs of the corrugations in the first section of each of the fin segments being joined to one of the first and second tube lengths in a first adjacent row and one of the first and second tube lengths in a second adjacent row, peaks and troughs of the corrugations in the second section of each of the fin segments being joined to the other of the first and second tube lengths in the first adjacent row and the other of the first and second tube lengths in the second adjacent row; and bending the monolithic heat exchanger core into an arcuate shape having a radial direction, such that one of the first and second tube lengths of each row is located radially inward of the other of the first and second tube lengths of each row, wherein bending of the monolithic heat exchanger core severs at least one of the connecting points of each fin segment.

2. The method of claim 1, further comprising the step of assembling a common header to first ends of the first and second tube lengths of each row of flat tubes at a first side of the core stack prior to brazing.

3. The method of claim 1, wherein each of the first and second tube lengths of each row is an individual tube, and wherein the first tube length and the second tube length each define a refrigerant flow pass for a first refrigerant.

4. The method of claim 2, further comprising the step of assembling a first header to a second end of the first tube length of each row at a second side of the core stack, and assembling a second header to a second end of the second tube length of each row at the second side of the core stack, prior to brazing.

5. The method of claim 4, wherein bending the monolithic heat exchanger core displaces the first header relative to the second header.

6. The method of claim 4, wherein the step of slitting the sheet of material does not remove material from the sheet, wherein after bending the monolithic heat exchanger core, the first tube length defines a first arcuate path and the second tube length defines a second arcuate path, wherein after bending the monolithic heat exchanger core, the first end of the first tube length of each row aligns with the first end of the second tube length of each row, and wherein after bending the monolithic heat exchanger core, the second end of the first tube length of each row aligns with the second end of the second tube length of each row along a second radial direction defined from a center of the first arcuate path to the second end of the first tube length of each row.

7. A method of making a heat exchanger, comprising:

slitting a single sheet of material along a longitudinal direction to define a first longitudinal section and a second longitudinal section of the sheet adjacent to the first section, and to form spaced-apart connecting points along the longitudinal direction between the first section and the second section;

forming the sheet of material to define serpentine corrugations;

separating the formed sheet of material into a plurality of fin segments, each fin segment having a plurality of the corrugations and one or more of the connecting points;

arranging the fin segments in alternating fashion between rows of flat tubes to define a core stack, each row comprising a first tube and a second tube in side-by side relation;

assembling a first header to a first end of the first tube of each row of flat tubes and to a first end of the second tube of each row of flat tubes at one side of the core stack prior to brazing;

assembling a second header to a second end of the first tube of each row;

assembling a third header to a second end of the second tube of each row;

brazing the first header, the second header, the third header, the fin segments, and flat tubes to form a monolithic heat exchanger core, peaks and troughs of the corrugations in the first section of each of the fin segments being joined to one of the first and second tube lengths in a first adjacent row and one of the first and second tube lengths in a second adjacent row, peaks and troughs of the corrugations in the second section of each of the fin segments being joined to the other of the first and second tube lengths in the first adjacent row and the other of the first and second tube lengths in the second adjacent row; and bending the monolithic heat exchanger core into an arcuate shape after brazing including severing at least one of the connecting points of each fin segment, displacing the second end of the first tube of each row relative to the second end of the second tube of each row such that the first tube of each row extends along a first arcuate path and the second tube of each row extends along a second arcuate path different than the first arcuate path, and maintaining relative positions between the first end of the first tube of each row and the first end of the second tube of each row.

8. The method of claim 7, wherein the first longitudinal section of each fin segment has a first length, wherein the second longitudinal section of each fin segment has a second length, and wherein the first length is equal to the second length.

9. The method of claim 7, wherein after bending the monolithic heat exchanger core, the first end of the first tube of each row aligns with the first end of the second tube of each row along a first radial direction defined from a center of the first arcuate path to the first end of the first tube of each row, and wherein after bending the monolithic heat exchanger core, the second end of the first tube of each row does not align with the second end of the second tube of each row along a second radial direction defined from a center of the first arcuate path to the second end of the first tube of each row.

10. The method of claim 7, wherein after bending the monolithic heat exchanger core, the first end of the first tube of each row aligns with the first end of the second tube of each row along a first radial direction defined from a center of the first arcuate path to the first end of the first tube of each row, and wherein after bending the monolithic heat exchanger core, the second end of the first tube of each row aligns with the second end of the second tube of each row along a second radial direction defined from a center of the first arcuate path to the second end of the first tube of each row.

11. The method of claim 7, wherein at least a portion of the first longitudinal section is displaced in relation to the second longitudinal section.

12. The method of claim 7, further comprising assembling a side plate to a top end of the core stack, the side plate having a gap extending at least partially along a length direction of the side plate and connecting points extending across the gap, wherein bending the monolithic heat exchanger core further includes shearing at least one of the connecting points of the side plate.

13. The method of claim 7, wherein the first header is located at an end of both the first arcuate path and the second arcuate path.

* * * * *